US010611618B2

(12) United States Patent
Yin et al.

(10) Patent No.: US 10,611,618 B2
(45) Date of Patent: Apr. 7, 2020

(54) AMPLITUDE LIMITING SYSTEM OF INSULATED AERIAL WORK PLATFORM

(71) Applicants: CHANG ZHOU CURRENT SUPPLY COMPANY OF JIANGSU ELECTRIC POWER COMPANY, Changzhou (CN); JIANGSU ELECTRIC POWER COMPANY, Nanjing (CN); STATE GRID CORPORATION OF CHINA, Beijing (CN)

(72) Inventors: Honghai Yin, Changzhou (CN); Liang Ji, Changzhou (CN); Zhen Xu, Changzhou (CN); Jianjun He, Changzhou (CN); Zehua Zhang, Changzhou (CN)

(73) Assignees: CHANG ZHOU CURRENT SUPPLY COMPANY OF JIANGSU ELECTRIC POWER COMPANY, Changzhou (CN); JIANGSU ELECTRIC POWER COMPANY, Nanjing (CN); STATE GRID CORPORATION OF CHINA, Beijing (CN)

( * ) Notice: Subject to any disclaimer, the term of this patent is extended or adjusted under 35 U.S.C. 154(b) by 170 days.

(21) Appl. No.: 15/535,597

(22) PCT Filed: Mar. 24, 2016

(86) PCT No.: PCT/CN2016/077231
§ 371 (c)(1),
(2) Date: Feb. 14, 2018

(87) PCT Pub. No.: WO2016/155561
PCT Pub. Date: Oct. 6, 2016

(65) Prior Publication Data

US 2018/0148308 A1 May 31, 2018

(30) Foreign Application Priority Data

Mar. 27, 2015 (CN) ..... 2015 1 0141996
Mar. 27, 2015 (CN) ..... 2015 2 0182443 U

(51) Int. Cl.
*B66F 17/00* (2006.01)
*B66F 11/04* (2006.01)

(52) U.S. Cl.
CPC ..... *B66F 17/006* (2013.01); *B66F 11/04* (2013.01); *B66F 11/046* (2013.01); *B66F 17/00* (2013.01)

(58) Field of Classification Search
CPC ..... B66F 11/00; B66F 11/04; B66F 11/044; B66F 11/042; B66F 11/046; B66F 17/00; B66F 17/003; B66F 17/006
See application file for complete search history.

(56) References Cited

U.S. PATENT DOCUMENTS 2,815,250 A * 12/1957 Thornton-Trump ..... B66F 11/044 182/112
3,082,842 A * 3/1963 Balogh ..... B66F 11/044 182/2.9

(Continued)

FOREIGN PATENT DOCUMENTS

CN 86202169 U 6/1987
CN 2548988 Y 5/2003

(Continued)

*Primary Examiner* — Catherine A Kelly
*Assistant Examiner* — Shiref M Mekhaeil
(74) *Attorney, Agent, or Firm* — Anova Law Group, PLLC

(57) ABSTRACT

The present disclosure provides an amplitude limiting system of insulated aerial work platform, including an insulated aerial work platform having a telescopic arm, an insulated folding arm and retractable supporting legs, a luffing cylin- (Continued)

der, a first pressure sensor, a balance valve, a selector valve, a flow meter, and a controller; the luffing cylinder is installed between the telescopic arm and the insulated folding arm and includes a hydraulic pressure chamber; the first pressure sensor is connected to the hydraulic pressure chamber of the luffing cylinder and is electrically connected to the controller; the balancing valve is arranged on the luffing cylinder; the selector valve is connected to the balance valve; the flow meter is connected in between the selector valve with the balance valve and is electrically connected to the controller.

3 Claims, 2 Drawing Sheets

(56) References Cited

U.S. PATENT DOCUMENTS 3,590,948 A * 7/1971 Milner, Jr. ..... B66F 11/044 182/2.1
3,680,713 A * 8/1972 Langley ..... B66F 11/044 212/288
3,741,337 A * 6/1973 Visinsky ..... B66F 11/044 182/148
3,757,895 A * 9/1973 Knutson ..... B66F 11/044 182/46
3,791,484 A * 2/1974 Harrison ..... B66F 11/046 182/2.2
3,807,575 A * 4/1974 Merrick ..... B66F 11/044 182/2.7
3,908,933 A * 9/1975 Goss ..... F02C 7/22 244/3.21
4,081,055 A * 3/1978 Johnson ..... B66F 11/044 182/19
4,089,388 A * 5/1978 Johnson ..... B66F 11/044 182/2.8
4,142,710 A * 3/1979 Okuda ..... B66C 23/80 212/304
4,226,300 A * 10/1980 Rallis ..... B66F 11/046 182/2.11
4,456,093 A * 6/1984 Finley ..... B66F 17/006 182/18
4,511,974 A * 4/1985 Nakane ..... G01G 19/083 340/685
4,549,400 A * 10/1985 King ..... B66F 11/044 417/12
4,550,747 A * 11/1985 Woodworth ..... G05D 7/0635 137/487.5
4,602,462 A * 7/1986 Anderson ..... B66F 11/044 182/2.9
4,660,729 A * 4/1987 Carbert ..... B66F 17/006 212/261
4,679,489 A * 7/1987 Jasinski ..... E21B 7/022 175/24
4,687,406 A * 8/1987 Kinsey ..... B66F 17/006 212/277
4,775,029 A * 10/1988 MacDonald ..... B66F 11/046 182/2.1
4,861,224 A * 8/1989 Holmes ..... B66F 11/044 414/680
5,016,767 A * 5/1991 Thibault ..... B66F 11/044 182/2.9
5,249,643 A * 10/1993 Backer ..... B66F 11/046 182/2.11
5,427,197 A * 6/1995 Waters ..... B66F 11/04 182/2.9
5,447,094 A * 9/1995 Geyler, Jr. ..... E02F 3/433 414/700
5,669,282 A * 9/1997 Tanino ..... E02F 3/433 414/700
5,780,936 A * 7/1998 Cardello ..... E06C 5/36 187/232
5,819,534 A * 10/1998 Fischer ..... B66F 11/044 60/424
5,944,204 A * 8/1999 Vollmer ..... B66F 11/044 182/2.9
5,947,516 A * 9/1999 Ishikawa ..... B60G 17/005 280/755
6,170,607 B1 * 1/2001 Freeman ..... B66C 15/065 182/18
6,202,013 B1 * 3/2001 Anderson ..... B66C 13/40 701/50
6,350,100 B1 * 2/2002 Naruse ..... B66F 9/22 414/635
6,351,696 B1 * 2/2002 Krasny ..... E04G 21/0436 701/50
6,611,746 B1 * 8/2003 Nagai ..... B66F 9/0755 187/222
6,842,119 B2 * 1/2005 Nurse ..... B66C 23/905 212/348
7,311,489 B2 * 12/2007 Ekman ..... B66C 3/005 294/86.41
8,505,684 B1 * 8/2013 Bogue ..... B66F 11/042 182/19
9,327,946 B2 * 5/2016 Stakor ..... B66C 23/84
9,550,475 B1 * 1/2017 Walker ..... B66C 23/78
10,183,852 B2 * 1/2019 Das ..... B66F 9/22
2003/0066417 A1 * 4/2003 Stephenson ..... B66C 23/88 91/515
2004/0016596 A1 * 1/2004 Promersberger ..... B66F 11/044 182/2.9
2004/0158380 A1 * 8/2004 Farber ..... B66F 17/003 701/50
2005/0218101 A1 * 10/2005 Montineri ..... B66C 23/701 212/349
2007/0056278 A1 * 3/2007 Montineri ..... B66F 9/065 60/413
2008/0011530 A1 * 1/2008 Oka ..... B60W 10/02 180/306
2008/0028924 A1 * 2/2008 Stephenson ..... B66F 17/003 91/445
2008/0034853 A1 * 2/2008 Tabor ..... B66F 9/0655 73/114.79
2008/0063501 A1 * 3/2008 Bitter ..... B66F 9/22 414/680
2009/0057065 A1 * 3/2009 Akaki ..... B60T 7/126 187/223
2010/0063682 A1 * 3/2010 Akaki ..... B66F 17/003 701/42
2012/0117962 A1 * 5/2012 VanDyne ..... F01N 3/103 60/600
2013/0048425 A1 * 2/2013 Thompson ..... B66F 17/006 182/46
2014/0241840 A1 * 8/2014 Tsuruta ..... B66F 9/22 414/639
2016/0101970 A1 * 4/2016 Taki ..... B66F 17/003 701/50
2017/0129757 A1 * 5/2017 Haunold ..... B66F 9/24
2018/0057332 A1 * 3/2018 Xu ..... A62B 35/0075
2018/0179035 A1 * 6/2018 De Jong ..... B66F 3/24
2019/0033158 A1 * 1/2019 Bonnet ..... G01M 1/14
2019/0071291 A1 * 3/2019 Puszkiewicz ..... B66F 9/0655

FOREIGN PATENT DOCUMENTS

CN 101284636 A 10/2008
CN 103601140 A 2/2014
CN 104724645 A 6/2015
CN 204529247 U 8/2015
JP 05147894 A 6/1993

* cited by examiner

AMPLITUDE LIMITING SYSTEM OF INSULATED AERIAL WORK PLATFORM

CROSS-REFERENCES TO RELATED APPLICATIONS

This application is a national phase entry under 35 U.S.C. § 371 of International Application No. PCT/CN2016/077231, filed on Mar. 24, 2016, which claims the priority to Chinese Patent Application No. 201510141996.2 and Chinese Patent Application No. 201520182443.7, both filed with the State Intellectual Property Office of P. R. China on Mar. 27, 2015, the entire contents of all of which are incorporated herein by reference.

FIELD OF THE DISCLOSURE

The present disclosure relates to the field of control technologies of aerial work platforms and, more particularly, relates to an amplitude limiting system of insulated aerial work platform.

BACKGROUND

With economic and social development, people's requirements for power supply continue to increase, along with more and more demand for live work, all kinds of insulated aerial work platforms came into being and have been very widely used. Research work has been done on the aerial work platform (work vehicle) that limits (or controls) the amplitude, such as application publication No. CN104591051A entitled "A Multi-mode Amplitude Control System for a Bent Armed Aerial Vehicle," application publication No. CN 102145869A entitled "A Safety Limiting System with Amplitude Limitation and Torque Limiting Redundancy," and issued patent publication No. CN 201713236U entitled "Height Limiting System Suitable for Aerial Operation Vehicles," and other Chinese patent documents. Although technical solutions are proposed from different perspectives for limiting amplitude or height of aerial work platforms, it is difficult to apply the above technical solutions to an insulated aerial work platform. In order to improve practicality and work safety, insulated aerial work platforms usually adopt a hybrid boom structure. That is, the lower part adopts a folding arm with an auxiliary insulation end, and the upper part adopts a telescopic arm with a main insulation end at the tail. Because the folding arm with the auxiliary insulated end is adopted at the lower part, it is difficult to install electronic sensors on the telescopic arm at the upper part to monitor operating status of the boom in real time, and to further realize amplitude control functionalities. Therefore, existing hybrid arm-type insulated aerial work platforms do not have amplitude limitation functionalities, limitation of the operation range can only be relied on manual control, which causes security risks.

BRIEF SUMMARY OF THE DISCLOSURE

The object of the present disclosure is to address problems in the prior art and to provide an amplitude limiting system of an insulated aerial work platform that does not need to lay electrical components on the telescopic arm of the insulated aerial work platform and that can implement precise amplitude limiting functions to ensure safety of aerial work.

The technical solution of the present disclosure is: an amplitude limiting system of insulated aerial work platform as disclosed, includes an insulated aerial work platform, the insulated aerial work platform including a telescopic arm, an insulated folding arm and retractable supporting legs; and the structural feature of which is that: it further includes a luffing cylinder, a first pressure sensor, a balance valve, a selector valve, a flow meter and a controller.

The luffing cylinder is installed between the telescopic arm and the insulated folding arm; and the luffing cylinder is provided with a hydraulic pressure chamber.

The first pressure sensor is connected to the hydraulic pressure chamber of the luffing cylinder through an insulated hydraulic pipeline which passes through, from bottom to top, the insulated folding arm; the first pressure sensor is electrically connected to the controller via a cable; the balancing valve is arranged on the luffing cylinder; the selector valve is connected to the balance valve by two hydraulic pipelines that pass through, from bottom to top, the insulated folding arm; the flow meter is connected to one of the two hydraulic pipelines that connects the selector valve with the balance valve; and the flow meter is electrically connected to the controller via a cable.

A further solution includes: it further includes second pressure sensors. The second pressure sensors are arranged on the retractable supporting legs of the insulated aerial work platform, and each of the retractable supporting legs being respectively provided with one of the second pressure sensors; and each of the second pressure sensors is electrically connected with the controller.

A further solution includes: the first pressure sensor is configured to detect, in real-time, a pressure received by the hydraulic pressure chamber, and send to the controller; the flow meter is configured to detect, in real-time, a flow volume that flows into or flows out of the luffing cylinder, and send detected information to the controller; the controller is configured to calculate, based on the flow volume detected by the flow meter, an amount of extension or retraction of the telescopic arm, and an angle of the telescopic arm relative to ground; and if the controller determines that the pressure exceeds an allowed maximum pressure corresponding to the angle, the controller is configured to send a signal to prohibit the telescopic arm from continuing to extend outwardly or luff downwardly.

A further solution includes: the second pressure sensors are configured to transmit detected pressure signal to the controller respectively; the controller is configured to obtain, based on data reported by the second pressure sensors, a sum of a weight of the entire insulated aerial work platform 1 and a load applied to the platform; and when the sum monitored by the controller is greater than a sum of the weight of the insulated aerial work platform and a maximum allowable load of the insulated aerial work platform, the controller is configured to determine that an overload occurs and send a signal to cut off all actions.

Figure 1:
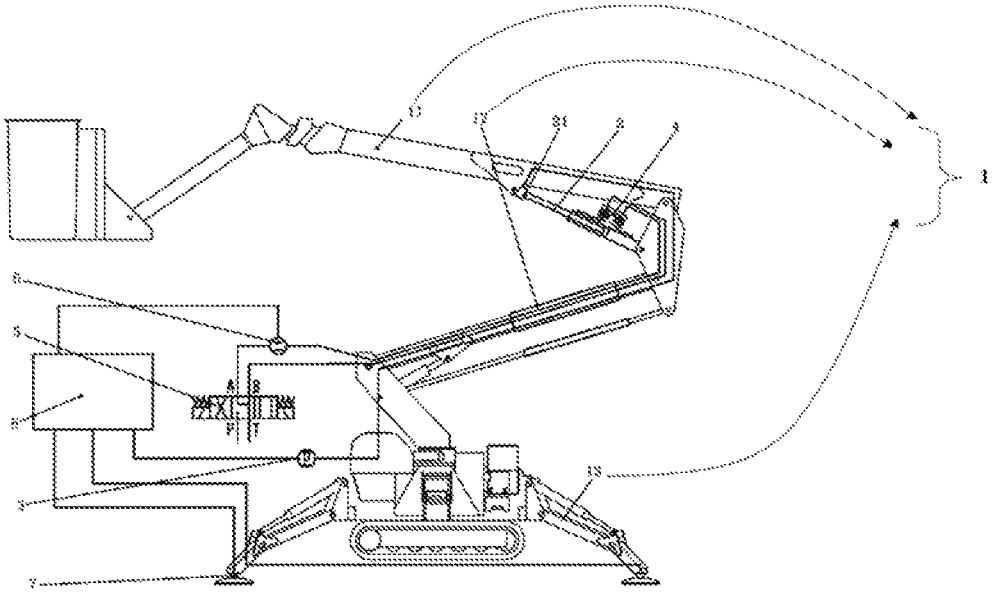
FIG. 1 is a diagram of an application example of the present disclosure.

Reference numbers used in the figures are as follows: insulated aerial work platform 1, telescopic arm 11, insulated folding arm 12, retractable supporting leg 13, luffing cylinder 2, hydraulic pressure chamber 21, first pressure sensor 3, balance valve 4, selector valve 5, flow meter 6, second pressure sensor 7, and controller 8.

DETAILED DESCRIPTION

The present disclosure is further described in detail together with accompanying drawings and specific embodiments.

Embodiment

Figure 2:
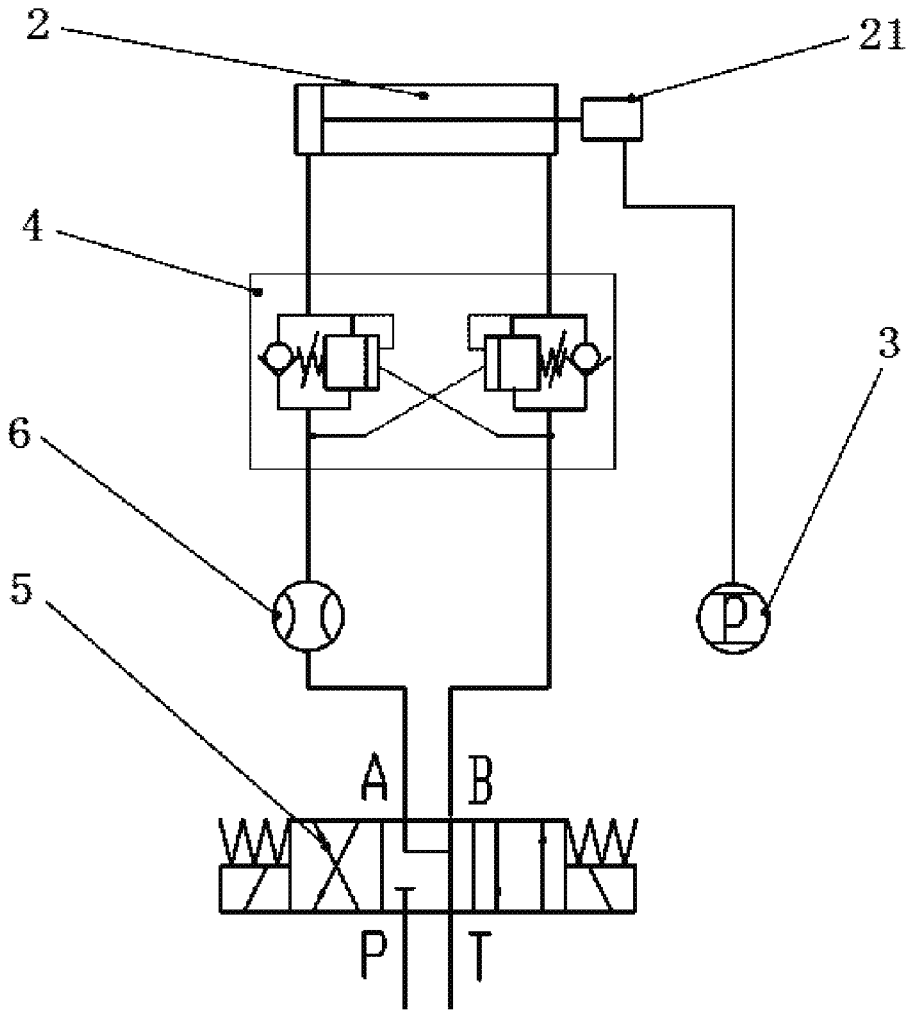
FIG. 2 is a schematic view of hydraulic principles of the present disclosure.

As shown in FIG. 1 and FIG. 2, an amplitude limiting system of insulated aerial work platform of the disclosed embodiment mainly includes: an insulated aerial work platform 1, a luffing cylinder 2, a first pressure sensor 3, a balance valve 4, a selector valve 5, a flow meter 6, second pressure sensors 7, and a controller 8.

The insulated aerial work platform 1 is an insulated aerial work platform that implements hybrid boom structure. The insulated aerial work platform 1 includes a telescopic arm 11, an insulated folding arm 12, and retractable supporting legs 13.

The luffing cylinder 2 is installed between the telescopic arm 11 and the insulated folding arm 12, and the telescopic arm 11 is driven by the luffing cylinder 2 to implement a luffing action. The luffing cylinder 2 is provided with a hydraulic pressure chamber 21, and the pressure received by the hydraulic pressure chamber 21 is the pressure received by the luffing cylinder 2.

The first pressure sensor 3 is connected to the hydraulic pressure chamber 21 of the luffing cylinder 2 through an insulated hydraulic pipeline which passes, from bottom to top, through the insulated folding arm 12; the first pressure sensor 3 enables remote monitoring of the pressure in hydraulic pressure chamber 21 of the luffing cylinder 2 through the hydraulic pipeline; the first pressure sensor 3 is electrically connected to the controller 8 via a cable.

The balancing valve 4 is arranged on the luffing cylinder 2. During operation, the balance valve 4 can, on the one hand, provide a back pressure for the luffing cylinder 2 during its movement, and improve the stability of the movement of the luffing cylinder 2; and can, on the other hand, lock the luffing cylinder 2 in the event of a pipeline failure, to prevent self-movement of the luffing cylinder 2 that leads to safety accidents.

The selector valve 5 is used for controlling the telescopic expansion and contraction of the luffing cylinder 2; the selector valve 5 is connected to the balance valve 4 by two hydraulic pipelines that pass through, from bottom to top, the insulated folding arm 12.

The flow meter 6 is connected to one of the two hydraulic pipelines that connects the selector valve 5 with the balance valve 4; the flow meter 6 is used for detecting the flow of the driving fluid during operation, and the flow meter 6 is electrically connected to the controller 8 via a cable.

The second pressure sensors 7 are arranged on the retractable supporting legs 13 of the insulated aerial work platform 1, and each of the retractable supporting legs 13 is respectively provided with one; each of the second pressure sensors 7 is electrically connected with the controller 8.

Application Example

When the amplitude limiting system of the insulated aerial work platform as disclosed in above embodiments is in use, the luffing cylinder 2 drives the telescopic arm 11 to realize outward extending and luffing action; and the pressure sensor 3 connected to the hydraulic pressure chamber 21 of the luffing cylinder 2 detects, in real-time, the pressure in the hydraulic pressure chamber 21 of the luffing cylinder 2, which is also pressure signal of the luffing cylinder 2, and transmits the signal to the controller 8. The flow meter 6 detects, in real-time, the fluid volume that flows into or flows out of the luffing cylinder 2, and converts detected information into an electrical signal and reports to the controller 8. The controller 8 receives the detection data of the flow meter 6 to calculate an extended state of the luffing cylinder 2, and accordingly determines an angle of the telescopic arm 11 relative to the ground at the current time.

When the telescopic arm 11 extends outwardly or luffs downwardly, the pressure monitored by the first pressure sensor 3 and the flow rate detected by the flow meter 6 can change correspondingly, and the controller 8 calculates, based on the flow rate detected by the flow meter 6, the amount of extension or retraction of the telescopic arm 11 and the angle with respect to the ground. If the controller 8 determines that the pressure exceeds an allowed maximum pressure corresponding to the angle, the controller 8 sends a signal to prohibit the telescopic arm 11 from continuing to extend outwardly or luff downwardly by controlling the hydraulic system of the insulated aerial work platform, thereby realizing the amplitude limiting functions, which ensures the safety of aerial work.

When in use, the second pressure sensor 7 disposed on each of the retractable supporting legs 13 of the insulated aerial work platform 1 transmits respectively detected pressure signal to the controller 8; and the controller 8 determines, based on data reported by all of the second pressure sensors 7, a sum of a weight of the entire insulated aerial work platform 1 and a load applied to the platform. When the sum weight monitored by the controller 8 is greater than a sum of the weight of the insulated aerial work platform 1 and the maximum allowable load of the platform, the controller 8 determines that overload occurs, and the controller 8 sends out a signal to cut off all actions by controlling the hydraulic system of the insulated aerial work platform, so as to further improve the safety performance of the insulated aerial work platform 1.

To sum up, compared with the prior art, the present disclosure determines the telescopic amount of the telescopic arm 11 and the angle with respect to the ground by remotely monitoring the hydraulic pressure of the luffing cylinder 2 and by monitoring the liquid flow rate in the luffing cylinder 2, which enables monitoring and controlling of operation range of works on an aerial work platform, and solves the problem that the range of hybrid insulated aerial working platform cannot be limited in the prior art. Meanwhile, the second pressure sensors 7 mounted on the retractable supporting legs 13 enable monitoring of loading condition of the platform, so as to prevent overload operation on the platform, and to further improve the safety of aerial work.

The foregoing embodiments and application examples are merely illustrative of specific embodiments of the present invention, rather than limiting the present invention. Persons skilled in the art may also make various changes and combinations without departing from the spirit and scope of the present invention so as to obtain the corresponding equivalent technical solutions. Therefore, all the equivalent technical solutions should fall within the scope of patent protection of the present invention.

INDUSTRIAL APPLICABILITY

The present invention has advantageous effects: compared with the prior art, the disclosed amplitude limiting system of insulated aerial work platform determines the telescopic amount of the telescopic arm and the angle with respect to the ground by remotely monitoring the hydraulic pressure of the luffing cylinder and by monitoring the liquid flow rate in the luffing cylinder, which enables monitoring and controlling of operation range of works on an aerial work platform, and solves the problem that the range of hybrid insulated aerial working platform cannot be limited in the prior art. Meanwhile, the second pressure sensors mounted on the retractable supporting legs enable monitoring of loading condition of the platform, so as to prevent overload operation on the platform, and to further improve the safety of aerial work.

What is claimed is:

1. An amplitude limiting system of an insulated aerial work platform, comprising: the insulated aerial work platform, wherein the insulated aerial work platform comprises a telescopic arm, an insulated folding arm, and retractable supporting legs;

wherein:

the amplitude limiting system further comprises: a luffing cylinder, a first pressure sensor, a balance valve, a selector valve, a flow meter, and a controller;

the luffing cylinder is installed between the telescopic arm and the insulated folding arm; the luffing cylinder is provided with a hydraulic pressure chamber;

the first pressure sensor is connected to the hydraulic pressure chamber of the luffing cylinder through an insulated hydraulic pipeline which passes, from a bottom of the insulated folding arm to a top of the insulated folding arm, through the insulated folding arm;

the first pressure sensor is electrically connected to the controller and is configured to detect, in real-time, a pressure received by the hydraulic pressure chamber, and send a pressure signal corresponding to the detected pressure to the controller;

the balance valve is arranged on the luffing cylinder;

the selector valve is connected to the balance valve by two hydraulic pipelines that pass through, from bottom to top, the insulated folding arm;

the flow meter is connected to one of the two hydraulic pipelines that connects the selector valve with the balance valve;

the flow meter is electrically connected to the controller and is configured to detect, in real-time, a flow volume that flows into or flows out of the luffing cylinder, and send a flow volume signal corresponding to the flow volume detected by the flow meter to the controller; and the controller is configured to:

calculate, based on the flow volume detected by the flow meter, an amount of extension or retraction of the telescopic arm, and an angle of the telescopic arm relative to ground; and in response to determining that the pressure exceeds an allowed maximum pressure corresponding to the angle, send a signal to prohibit the telescopic arm from continuing to extend outwardly or luff downwardly.

2. The amplitude limiting system of insulated aerial work platform according to claim 1, further comprising:

two second pressure sensors;

wherein, the two second pressure sensors are arranged on the retractable supporting legs of the insulated aerial work platform, and each of the retractable supporting legs being respectively provided with one of the two second pressure sensors; and each of the two second pressure sensors is electrically connected with the controller.

3. The amplitude limiting system of insulated aerial work platform according to claim 2, wherein:

the second pressure sensors are configured to transmit detected pressure signal to the controller respectively;

the controller is configured to obtain, based on data reported by the second pressure sensors, a sum of a weight of the entire insulated aerial work platform and a load applied to the platform; and when the sum monitored by the controller is greater than a sum of the weight of the insulated aerial work platform and a maximum allowable load of the insulated aerial work platform, the controller is configured to determine that an overload occurs and send a signal to cut off a luffing action of the telescopic arm.

* * * * *